United States Patent [19]

Goavec

[11] 4,125,061

[45] Nov. 14, 1978

[54] METHOD FOR THE PRODUCTION OF FILTER STRUCTURE FOR CIGARETTE FILTERS

[76] Inventor: Ernest Goavec, 16 Bis rue Emile Zola, 66004 Perpi Gnan, France

[21] Appl. No.: 692,010

[22] Filed: Jun. 1, 1976

[30] Foreign Application Priority Data

Jun. 19, 1975 [FR] France ..... 75 19233

[51] Int. Cl.[2] ..... A24C 5/50

[52] U.S. Cl. ..... 93/1 C; 93/77 FT

[58] Field of Search ..... 93/1 C, 77 FT, 1 WZ; 131/10.5, 10.7, 261 B

[56] References Cited

U.S. PATENT DOCUMENTS

| | | | |
|---|---|---|---|
| 2,931,748 | 4/1960 | Müller | 93/1 C X |
| 3,418,890 | 12/1968 | Tachibana et al. | 93/1 C |
| 3,518,921 | 7/1970 | Müller | 93/1 C |

FOREIGN PATENT DOCUMENTS

| | | | |
|---|---|---|---|
| 40,370 | 9/1968 | Finland | 131/261 B |
| 1,433,797 | 2/1966 | France | 131/10.5 |
| 1,160,222 | 7/1958 | France | 131/261 B |

*Primary Examiner*—James F. Coan

*Attorney, Agent, or Firm*—George B. Oujevolk

[57] ABSTRACT

The present invention relates to a method for assembling a highly efficient cigarette filter by making a new type of filter structure starting with a sheet of fiber material, this sheet being shaped as a cylindrical casing according to known geometric shaping arrangements. More particularly, according to this method there is employed a sheet of fiber material which is transversally corrugated and which acts as an absorbent with regard to the products of tobacco smoke, and, there is impressed on certain portions of this sheet a wafer relief configuration so as to obtain on this sheet two different materials, the sheet is then cut into ribbons of the same width which are gathered in the form of a pile, said pile being then geometrically shaped in a cylindrical casing of homogeneous structure.

8 Claims, 25 Drawing Figures

FIG. 2
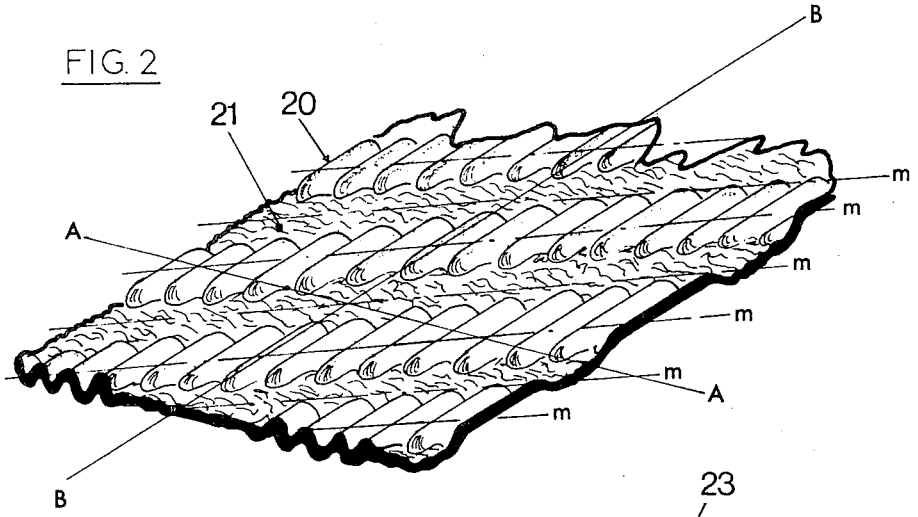
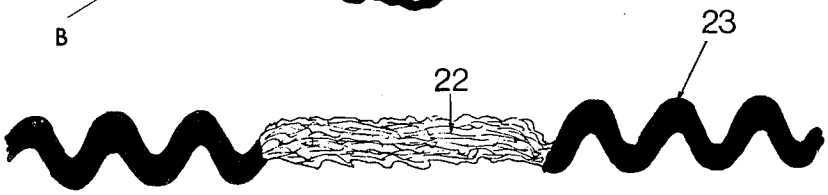
FIG. 2A
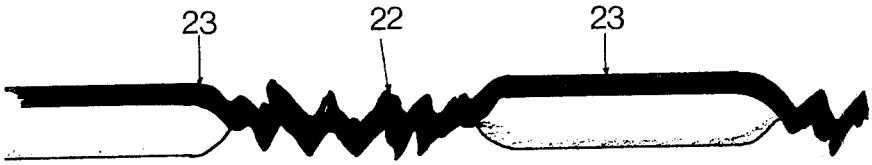
FIG. 2B

FIG. 3
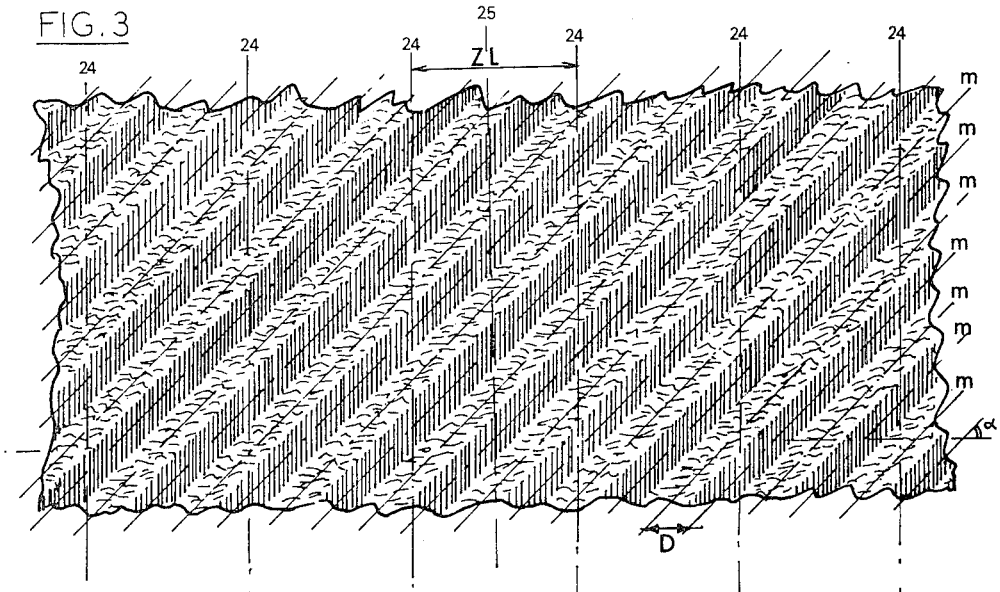
FIG. 4
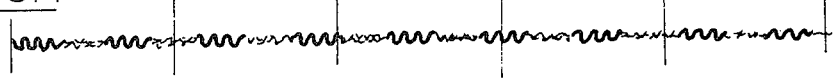
FIG. 5
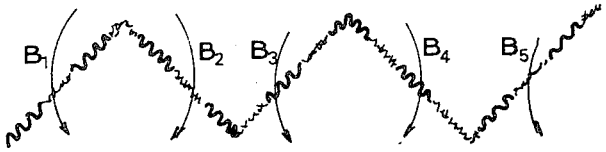
FIG. 6
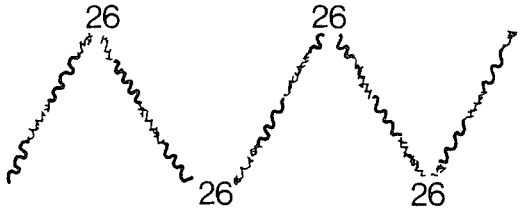
FIG. 7
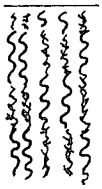
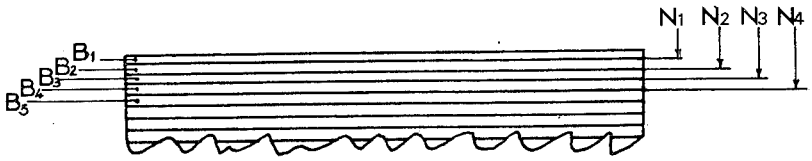
FIG. 8

METHOD FOR THE PRODUCTION OF FILTER STRUCTURE FOR CIGARETTE FILTERS

BACKGROUND OF THE INVENTION

The present invention relates to a process for assembling a highly efficient cigarette filter by making a new type of filter structure starting with a sheet of fiber material; this sheet being shaped as a cylindrical casing according to known geometric shaping arrangements.

BRIEF DESCRIPTION OF THE PRIOR ART

Cigarette filters made by spirally rolling a sheet of fiber material transformed by forming wafers on certain surface portions in the form of small reliefs alternating with other portions not so transformed, thus retaining their original state are already known. These reliefs, according to the configuration selected are produced by bosses, either hemispheric, triangular, or in labyrinth. These configurations are usually disposed in random manner so as to define in the filter cylinder a multiplicity of narrow, tortuous passages through which the smoke flows, these passages being interrupted by dead ends.

There is also known another arrangement comprising forming cylindrical filters starting with at least two sheets on which are superposed fiber material, rolled in a spiral, each having previously been transformed by folding, the parallel folds of one sheet being intersected by the parallel folds of the other superposed sheet so as to form a network of quadrilateral channels for the passage of tobacco smoke. Although the configuration of the reliefs on the pressed fiber sheets are different, the filters obtained from these sheets have the common defect that they are all made by forming into a spiral shape by rolling to a center where the principle and the result are not appropriate for obtaining a filter performance. Indeed, the rolling more or less roughly of a spiral on a center of sheets of material does not aid in the construction of a geometric structure formed by zones in relief and zones which are intact. Indeed, the spiral structure resulting from such a rolling causes of necessity a progressive tightening of the designs in relief, as one approaches the center of the spiral, since the repitition rate of these reliefs is constant whereas the spiral curvature radius shrinks from the periphery to the center of the filter. This progressive concentration of the reliefs in the direction of the filter axis creates a lack of homogenity to the filter structure such that the particular surface of the fiber material is not fully utilized for the filtering of the tobacco smoke tar.

There is also known another method of geometric formation (French Patent No. 1,536,323 of June 30, 1967) which allows the production of cigarette filters of a homogeneous performance. According to this method, the filter structure is made starting with several sheets of different fiber materials (one cover sheet of wafer type, and two wad sheets of cellulose) assembled by superposing as a composite sheet which is cut into ribbons of about the same width, these ribbons being assembled one against the other before being progrssively shaped in a cylindrical filter casing which is spiral S-shaped in cross-section, that is to say, a spiral cartridge with two centers.

In any event, if this method provides a type of filter of satisfactory quality, it also has the inconvenience of not being adapted to speed in modern filter manufacturing. Indeed, knowing on the one hand that the wadded spools have little density ($\phi$ 1 m approximately for relatively short lengths of the order of 2,000 m), and also the permissible changing of the spools is about 5 minutes, and there are two such spools, the speed of the filter machine is thus limited to 200 meters per minute, whereas modern filter machines can attain 400 meters per minute.

OBJECTS OF THE INVENTION

An object of the invention is to remedy this inconvenience by making full use of the new filter making machines by using one or two spools having an extended length of fiber material in place of one armature spool and two wadded spools, which while permitting speeds of the order of 400 meters per minute to be attained, (twice the speed possible by the "S" method), does not increase, and even decreases, the frequency of changing spools of material used.

Therefore, another object of the invention is to combine the advantages inherent to the use of a single sheet of material with those resulting from a geometrical shaping, principally spiral S-shape.

A further object of the invention is to provide a method for making cigarette filters of high efficiency by forming a new type of filter structure starting with a sheet of fiber material, the sheet being formed in a cylindrical shape according to a known method, the filter cylinder according to the manufacturing method, being made of ribbons cut out of the sheet and assembled one against the other, this method generally comprising using a sheet of fiber material transversally corrugated which acts as an absorbent with regard to the products of tobacco smoke, and wherein said sheet is not appropriate for the formation of, in its original state, a proper cigarette filter structure. The sheet is transformed by a combined arrangement into a cylindrical casing and there is obtained by this combination a new type cigarette of filter structure, the object of the transformation being to obtain two different materials in one single sheet by creating on certain portions of the surface of the sheet, a new state of the material and a new relief design while leaving other portions intact in their original corrugated state, the operation performed on certain portions of the sheet consisting in increasing the density of the material by crushing the transverse folds of the corrugation and forming a relief design having fine longitudinal canals or channels of the wafer type, that is to say, orthogonal to the transverse corrugation folds, these folds being thus rigidified by the density of the material and by the folds of the relief, the rigidified portions and the portions which are intact in their corrugated state being situated on the surface of the sheet in a geometric outline appropriate for the formation of a new type of filter structure, this geometric outline being composed of at least one design occupying on the sheet an endless longitudinal surface and of a given length equal to the length of the sheet, the portions forming a design being bands defined by equidistant parallel straight lines, the rigid, i.e., rigidified bands alternating with the corrugated bands, the parameters of such a design being its width and the two parameters of the bundle of straight lines of the center bands, that is to say, the dimension of the intervals of the center measured in the direction transverse to the sheet, the angle formed by the direction of the center and the direction transverse to the sheet.

Several structural models are produced in transforming the sheet according to different designs. The sheet is cut in ribbons of equal lengths with the rigidified and corrugated bands of each ribbon emenating from the cutting of the bands on the sheet. Each ribbon is pivoted 90° about its central axis, the effect of which is to align the ribbons in parallel planes and to prepare their assembly, the direction of pivoting the ribbons of even rows in relationship to those of the ribbons of the odd rows being determined by taking into consideration the parameters of the designs formed by the bands on the ribbons so as to obtain, when assembling the ribbons, an intersection of the even ribbon bands with the odd ribbon bands, obtaining by this a double result, building on the one band the elements of the skeleton, and on the other band forming the texture of the filter network, the skeleton being built as a trellis by the rigidified bands intersecting and connected between themselves by certain overlapping of their canals, so as to obtain a compact structure by construction and not by piling of the material, and therefore, open for the passage of smoke, moreover, in assembling the ribbons, absorbing textures are formed by assembling the materials which are rigidified and longitudinally canaled and materials transversally corrugated, this assembly being achieved by the way the bands are covered. Three types of textures are formed in the three combinations of the two assembled materials, the assembling of a rigidified or rigid material and of a corrugated material, forming canals for the passing of smoke in the longitudinal channels of the rigidified material defined by the transverse folds of the corrugated material, the assembly of the two corrugated elements forming absorbing cells scarsely compacted in which there is produced a certain amount of smoke expansion, these cells being mostly open in the direction transverse to the ribbon, the assembly of rigidified and longitudinally canaled elements forming longitudinal passages between the canals. These passages are choked in the event that the beds are blocked, the amount of blocking and choking of the passages being determined by the relief formed on the rigid bands. A filter network obtained is formed by the avenues through which the smoke passes in these three textures disposed in accordance with a geometric design by covering the bands, the absorbent properties of the material being produced by the three textures, their differences being favorable for the filtration because of the change in direction. Thus, the expansion and choking which they cause in funneling the smoke creates for this reason a highly efficient filter network.

SUMMARY OF THE INVENTION

The invention thus contemplates a fiber material to carry out the foregoing process wherein the fiber material consists of a sheet formed by at least one bed of cellulose absorbent wad corrugated in the transverse direction. This sheet is transformed in such a manner as to present a design composed of rigidified bands alternating with corrugated bands disposed between parallel equidistant straight lines forming a predetermined angle with any transverse direction of the sheet.

The invention also contemplates an arrangement for making a new type of filter structure starting with one or several sheets of fiber material transformed according to a preset design wherein the ribbons are cut out of said sheet or sheets and assembled in a spiral S-shape to obtain a cylindrical casing.

The invention also contemplates a machine to carry out the foregoing shaping arrangement as well as to make the filters obtained and the cigarettes equipped with these filters.

Other objects and advantages of the invention will be more apparent from the following detailed description when taken together with the accompanying drawings, in which:

BRIEF DESCRIPTION OF THE DRAWINGS

FIG. 2 is a partial perspective view of the sheet of fiber material after being treated in accordance with a design formed by parallel oblique bands of equal width alternately rigidified and corrugated;

FIG. 2A is a view of a transverse cut of the sheet shown in FIG. 2 along line A—A;

FIG. 2B is a view of a longitudinal cut of the sheet shown in FIG. 2 along the lines B—B;

FIGS. 3 to 7 are views illustrating different stages in assembling the ribbons, one against the other in the vertical position, wherein;

FIG. 8 represents a schematic explanation of a transverse section of ribbons shown in FIG. 7, these ribbons being disposed horizontally one against the other; and, FIGS. 3A to 3D are views showing details of the defined spacings formed by the intersection of contiguous ribbon bands cut in the sheet in accordance with FIG. 3 and marked at the four successive levels N1, N2, N3, N4 seen in FIG. 8; also.

DETAILED DESCRIPTION

Figure 1:
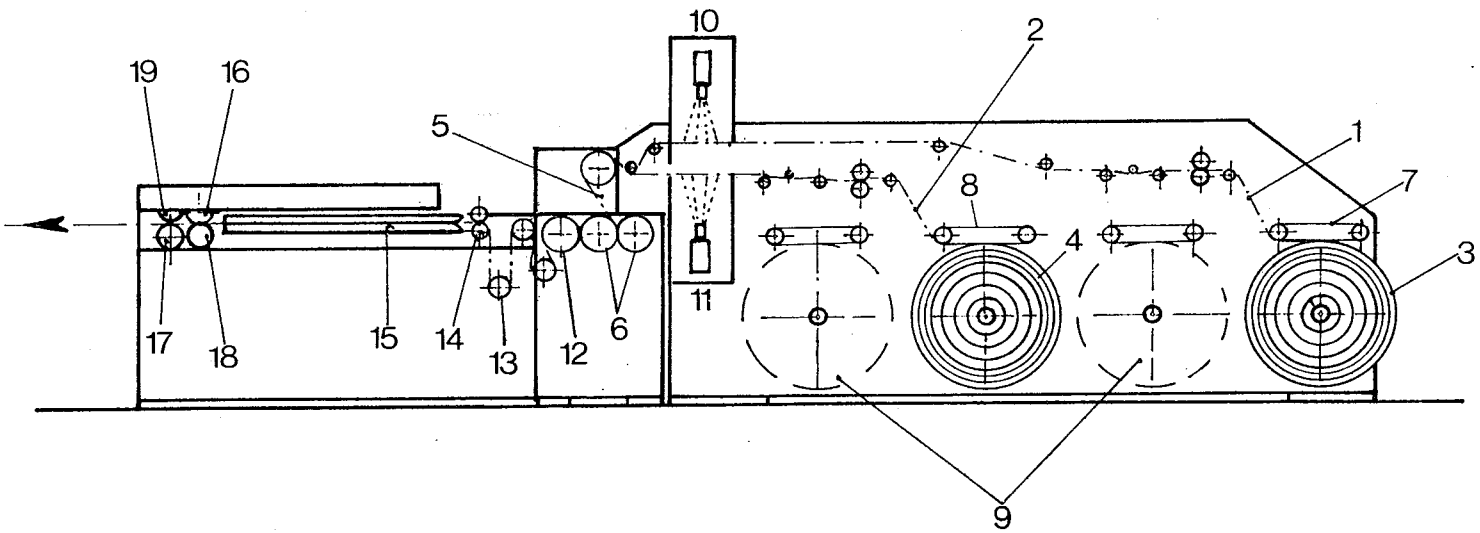
FIG. 1 is a longitudinal side elevation of the apparatus used to carry out the method herein described.

At the start (FIG. 1) there are two layers of fiber material 1 and 2 unwound at a speed controlled by two payoff spools 3 and 4.

Advantageously, the material is selected from wads of absorbent cellulose having a rate of elongation by unfolding, and a height of fold relatively weak in comparison with the values for the same characteristics for standard wad absorbents, such as used in the method described in, and the object of French Patent No. 1,536,323 of June 30, 1967.

These two layers are assembled by superpositioning on a double sheet 5 just before the treatment work station 6. This treatment work station 6 consists of a pair of wafering cylinders patterned according to the design required to be produced on the sheet fiber material.

The speed of the wafering cylinders 6 is determined by the speed of the machine making the filter (not shown).

The speed of pay-off of each layer 1 and 2 from spools 3 and 4 is less than the speed of the wafering cylinders to create, if necessary, a certain amount of unfolding in each layer where the amount determines the resistance to the pull of the filter. The constant value of the resistance is assured by fixing the amount of unfolding and adjusting the spacing speed. Indeed, the unfolding of the layers of the material, reducing the length of their transverse corrugated folds, results in reducing the resistance to pulling of the filter, providing an instant correction to the spacing resistant to the pulling which reduces the speed of this effect.

The pay-off by spools 3 and 4 is obtained by means of friction belt drives 7 and 8 at speeds which can be regulated. The spools shown schematically at 9 await unrolling and are to be used after spools 3 and 4.

According to one advantageous characteristic of the invention the stiffness of the wafered sheet is increased by subjecting the two layers 1 and 2 prior to their transformation to a light water dampening treatment by means of pulverization devices 10, 11 already known, located on one side and the other of said layers. Double sheet 5, still damp, exiting the wafering cylinders is dried by passing on drying cylinders 12, disposed immediately following wafering cylinders 6. This dampening treatment reduces considerably the static electric charge which normally developes in a material when it is hot-wafered as it travels because of rubbing on metal components of the S-shaped spiraling device.

The sheet of transformed material is dried and then sent forward, after passing over an intermittent roller 13, to a dynamic marking unit 14 consisting of aligned rotating discs aligned on two axes and alternately applied to the two faces of the sheet of material in order to, on the one hand lay out the folding lines, and on the other hand pull the sheet. The fixed folding device 15 has converging elongated regulating means which penetrate one within the other by acting simultaneously on the lines of the marks made on the two faces of the sheet to fold it like an accordion.

On leaving this folding station, the sheet of material folded like an accordion is cut into ribbons of equal width by means of two sets of rotating knives 16, 17, rotating at the speed of the sheet and press applied to corresponding rollers 18, 19, the sets of knives 16 and 17 cutting respectively the summits of the folds above and below the sheet folded as an accordion.

The treatment of the sheet of material is rendered necessary because, when used in this state to make a filter, the sheet deprived of its rigidity does not allow the obtaining of compactness except to the detriment of resistance to pulling of the filter by using an excessive quantity of material.

The sheet wad of cellulose is thus transformed by creating, as shown in FIGS. 2, 2A, 2B, on certain portions of the surface 20 a new type of the material, and a new relief design and leaving intact other portions 21 in their original corrugated state 22, thus, two different materials are obtained on the surface of the sheet. The treated portions 20 are densified by crushing the transverse folds of corrugation. The relief thus rigidified is made up of five canals 23 which are longitudinal, rectilinear, uniform in shape, not too distant from the wafer type.

In the practical example shown, the rigid or rigidified portions 20 and the intact portions 21 of the design are bands defined by equidistant parallel straight lines, the rigid bands alternating with the corrugated bands, the bundle of straight lines *m* parallel and equidistant (FIG. 2) being the bundle of the central bands. The design of the sheet shown in FIG. 3 corresponding to FIG. 3 is defined by two parameters:

1. The dimension D of the space between the two contiguous middle lines *m* measured in a direction transverse to the sheet.

2. The angle $\alpha$ formed by the direction of these middle lines *m* and the transverse direction of the sheet. In the example given, angle $\alpha$ is 45°.

According to FIGS. 3–7, the sheet of transformed material is marked by means of devices 14 (FIG. 1) following longitudinal lines 24 facilitating the folding of the final cut of the ribbons. The sheet of wafered material (FIG. 4) so marked is then folded longitudinally as an accordion (FIG. 5). The longitudinal zones 2L of equal length precede the ribbons B1, B2, B3, B4 (FIG. 5) passing progressively from the horizontal position to the vertical position by pivoting around their middle axis 25. The odd zones B1, B3, B5, etc., pivot in one direction and the even zones B2, B4, etc., pivot in the opposite direction (see arrows FIG. 5).

The accordion folding is accomplished progressively in the direction of unrolling of the sheet until the point where the angles at the summit are 45° (FIG. 6).

At this state the converging distance of the longitudinal zones ZL is elongated by a parallel distance so as to allow a clean cut of ribbons of equal width at the level of the upper and lower summits 26.

After this cut, the ribbons so obtained converge by continuing the alternating pivoting movement of the accordion and are gathered vertically (FIG. 7). The ribbons are assembled one against the other, the bands of even ribbons are inter-crossed with the bands of odd ribbons. This intersecting defines figures of square shape (FIGS. 3A to 3D) formed by coverings of rigid bands 20 and corrugated bands 21.

FIG. 8 is a schematic view of a transverse partial section of the parallelopiped formed by assembled ribbons, on which the four successive levels N1, N2, N3, N4 are indicated which are formed respectively by pairs of contiguous ribbons of different parts B1-B2, B2-B3, B3-B4, B4-B5.

At each level (FIGS. 3A to 3D) the cover figures in the form of a square with two ribbons of different kinds form a pure quadrilateral.

(I) Square 27 (FIGS. 3A, 3E, 3F) transversed at its center by lines A-A and B-B is formed by the fold of rigid band 28 and ribbon B-1 crossed by rigid band 29 of ribbon B2 (rigid on rigid).

(II) Square 30, crossed by line A-A (FIGS. 3A, 3E) is formed by the fold of corrugated band 33 of ribbon B1 intersected by the corrugated band 31 of ribbon B2 (corrugated band 31 of ribbon B2 (corrugated on corrugated).

(III) Square 32 (FIGS. 3A, 3F) is formed by the fold of rigid band 28 of ribbon B (intersected by corrugated band 31 of ribbon B2 (rigid on corrugated).

(IV) Square 34 (FIG. 3A) is formed by the fold of corrugated band 33 of ribbon B1 intersecting with rigid bad 29 of ribbon B2 (corrugated on rigid).

Thus in each level of folding of the two contiguous ribbons, each group of 4 squares such as groups 27, 32, 30, 34 (FIG. 3A) is formed by twins of the following relief providing four textures, i.e.;

rigid upon rigid 27, (vertical continuous characteristic in alternating with vertical discontinuous characteristics in a proportion of 25%);

rigid upon corrugated 32, (vertical continuous characteristics crossed with undulated horizontal lines in a proportion of 25%);

corrugated upon rigid 34 (discontinued vertical characteristics crossed with undulated horizontal lines in a proportion of 25%).

By selecting the transverse direction of the interval separating two middle lines *m* in the series of odd submultiples of two ribbons, the correctness of the squares formed by the folds of each pair of contiguous ribbons (FIGS. 3A, 3D) are identical and can be superposed one on the other.

Figure 3A:
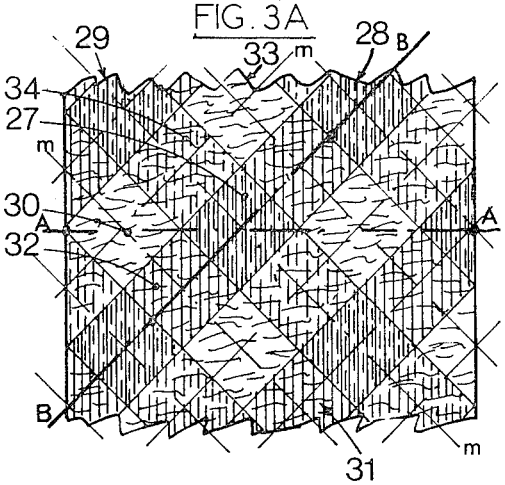
Figure 3B:
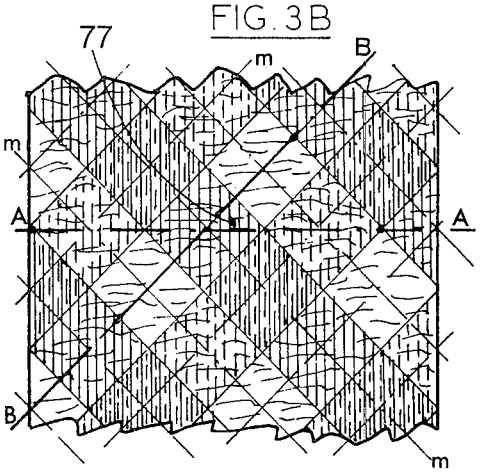

In the example given the sub-multiple is equal to 1/7th the width of the two ribbons, which means that each ribbon width can be divided in 3.5 intervals of middle lines (FIG. 3A, line A-A).

Figure 13:
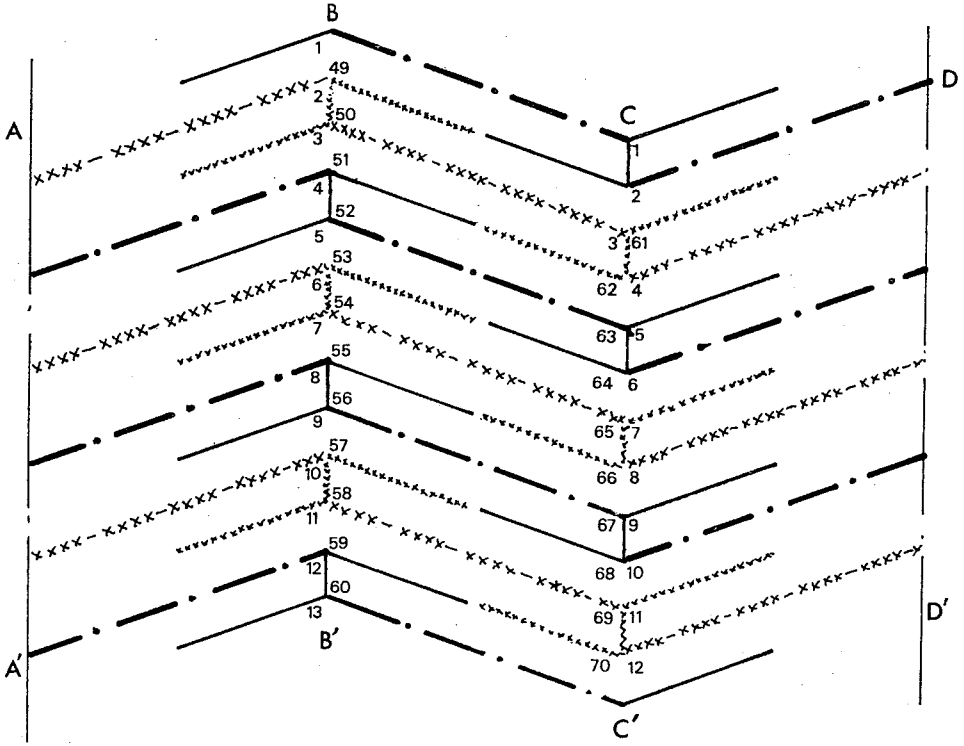
FIG. 13 is an enlarged schematic view of the window F shown in FIG. 14.
Figure 14:
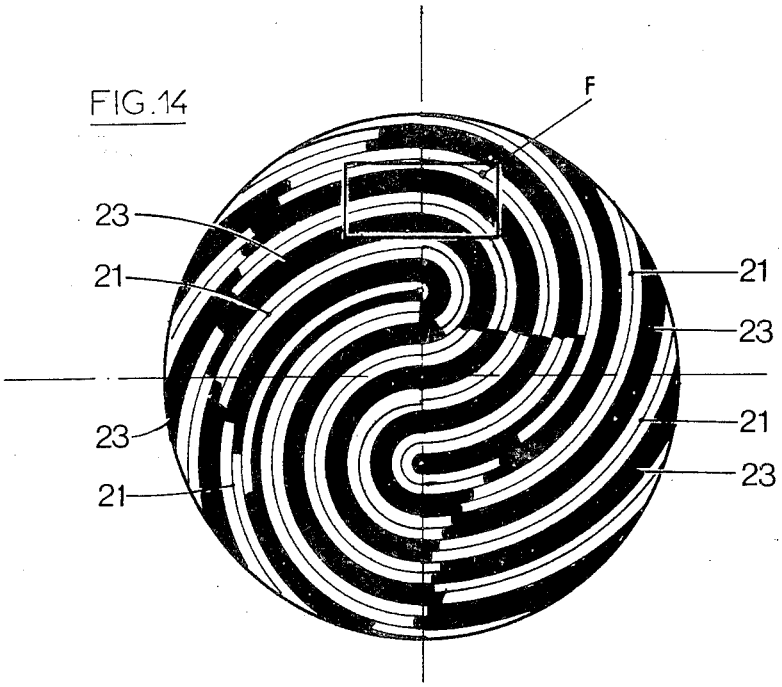
FIG. 14 presents a transverse cut through a cylindrical filter casing obtained after partially shaping the ribbon assembly shown in transverse cut in FIG. 3E.
Figure 15:
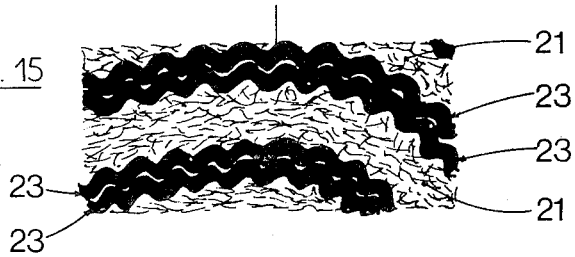
FIG. 15 is a detailed view of rectangle F shown in FIG. 14.
Figure 16:
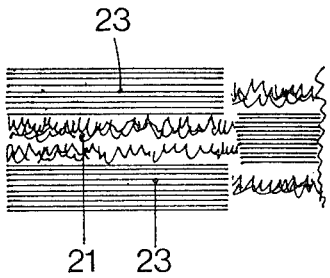
FIG. 16 shows a longitudinal view corresponding to FIG. 15.
Figure 17:
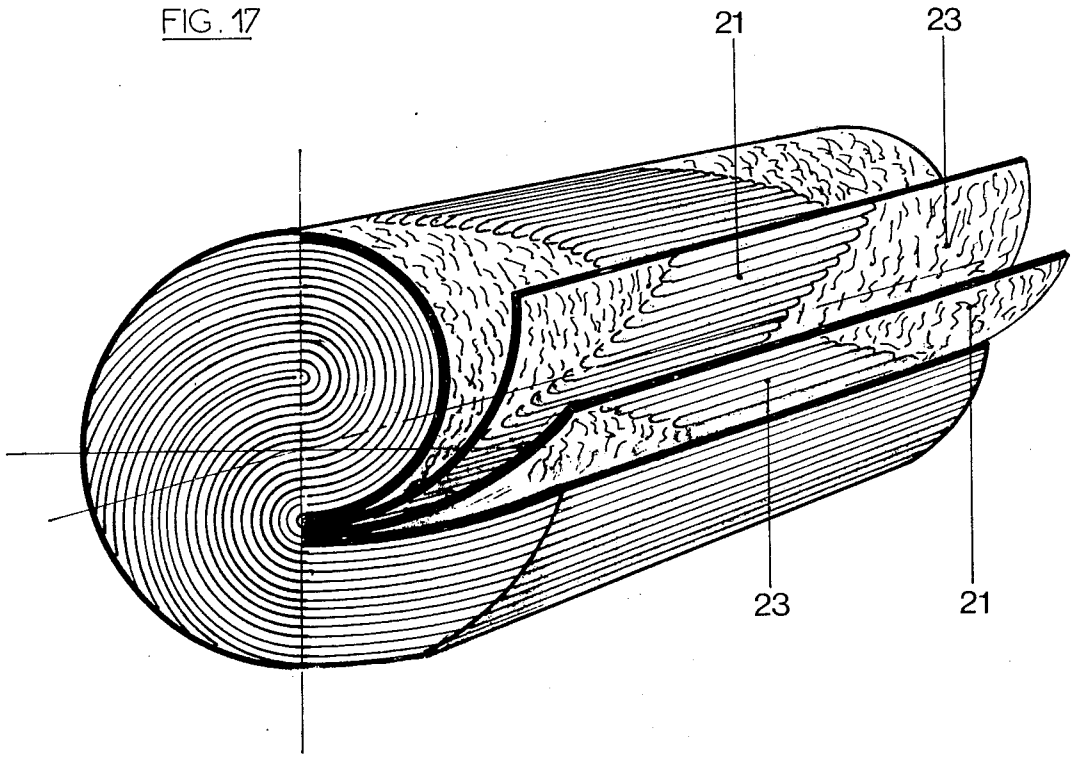
FIG. 17 presents a perspective view of a filter according to the inventive concept purposely cut open axially to show the intersection of the rigidified bands in a lattice, and the corrugated bands of contiguous ribbons.

In the assembled ribbons, the middle lines of the ribbon bands of the same parts are located in parallel planes between them (center planes), and perpendicular to the surface of the ribbons (FIG. 13). Each center plane formed by middle lines of odd ribbons is perpendicular to all center planes formed by the middle lines of the even ribbons.

Figure 12:
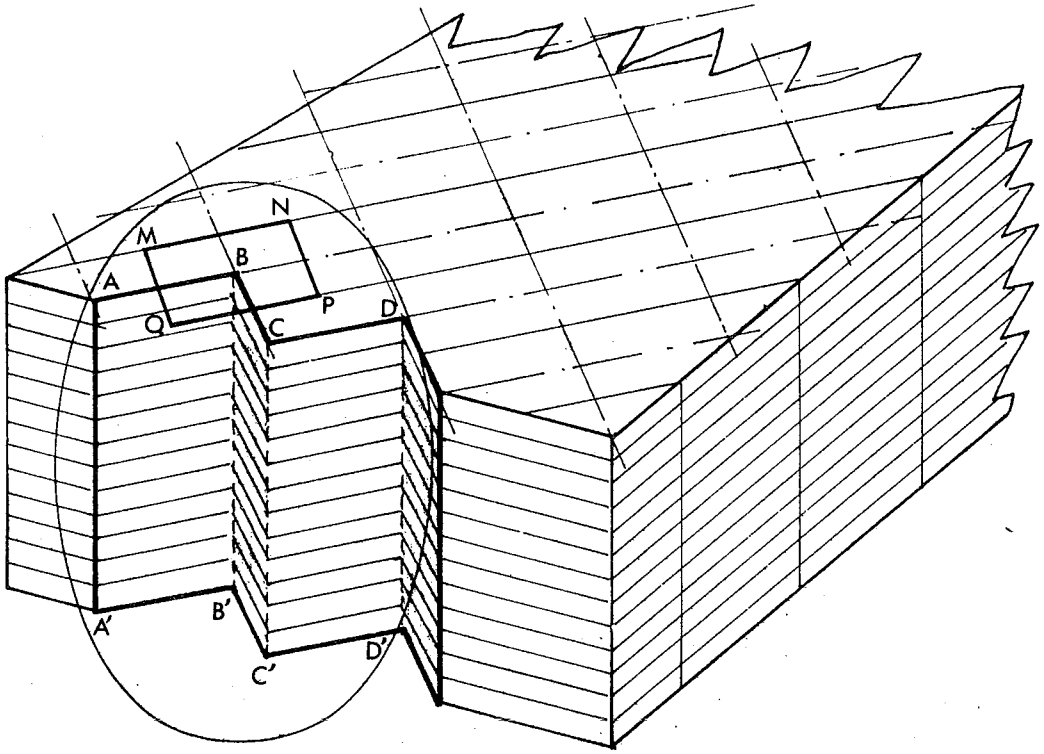
FIG. 12 is a schematic view in perspective of the parallelopiped formed by ribbons assembled by superpositioning, wherein one of the front faces has been notched so as to display two median perpendicular planes of two contiguous stratified prisms.

The center plane ABA'B1 is perpendicular to center plane BCB'C', which itself is perpendicular to the center plane CDC'D' (FIGS. 12 and 13).

Furthermore, in the center plane ABA'B1, the middle lines of corrugated bands (see FIG. 13) (straight lines made with crosses interrupted by hyphens) of ribbons 2, 6, 10 are alternated with the middle line or rigid bands (straight full lines interrupted by dots) of ribbons 4, 8, 12.

Likewise, in the middle plane BCB'C', the middle lines of corrugated ribbon bands of ribbons 3, 7, 11 are alternated with the middle lines of the rigid bands 1, 5, 9, 13.

Likewise, in the middle plane CDC'D' the middle lines of corrugated ribbon bands 4, 8, 12 are alternated with the middle lines of rigid ribbon bands 2, 6, 10 etc.

Thus, in the assembly formed by ribbons assembled one against the other a sequence of four ribbons is repeated identically, the first and third ribbons of the sequence on the one hand and the second and fourth ribbons on the other hand have their band outlines identically in the same position.

The relief of the bands comprising the outline being inverse. On the other hand, the ribbons of different parity and contiguous have the outline of intersecting bands.

In the oblique cut of FIG. 3A following line B-B (FIG. 3F), rigid band 28 of ribbon B1 is found disposed in an identical manner over ribbon B5.

Corrugated band 35 of ribbon B3, traced in the same way as rigid band 28, but of inverse relief is disposed identically on ribbon B7. On the other hand, rigid band 28 of ribbon B1 is intersected respectively with corrugated band 31, rigid band 29 and corrugated band 31 bis of ribbon B2.

The type of structure described in the practical example is thus a stratified structure, the stratification operating alternately in layers of two rigid bands and two corrugated bands.

This structure is composed of prisms of stratification (section MNPQ, FIG. 12) formed by the fold spaced in squares of bands wherein the central ones are located in a certain central plane (for example, ABA'B') for the even bands (intersecting the first mentioned at 90°) wherein the central ones are also located in some same plane (perpendicular to the first one) of odd ribbons (for example, BCB'C).

The two defined middle planes intersect along line BB'. The intersections with BB' of the center of the two planes are aligned in a sequence which is that of the stratification of the layers in the prisms.

Thus, in FIG. 13, points of intersection 49 and 50 correspond to two centers of corrugated bands. Points of intersection 51 and 52 correspond to two centers of rigid bands. Points of intersection 53 and 54 correspond to two centers of corrugated bands, etc. This alternation is repeated in FIG. 13 at the intersections 55–56, 57–58, 59–60.

Thus, in whatever prism, two adjacent points of intersection which correspond to two centers of corrugated bands are alternated with two points of adjacent intersections for two rigid bands.

Furthermore, intersection points 61 and 62 correspond to two centers of corrugated bands. Points 63 and 64 correspond to two centers or rigid bands. Points 65 and 66 correspond to two centers of corrugated bands, etc. This alternation is repeated for points of intersection 67–68 and 69–70.

Thus, in the two contiguous prisms, the points of intersection correspond to rigid bands and those corresponding to rigid bands and those corresponding to corrugated bands are removed one row in the order of alignment.

The stratified structure described in this practical example is thus formed by alternating layers of two rigid bands and two corrugated bands in all the prisms of the structure, the level of stratification being separated from the thickness by a band of two contiguous prisms. In FIG. 3E is shown in transverse cut a simple prism formed by squares of folds:

27 (rigid on rigid)
36 (corrugated on corrugated)
37 (rigid on rigid)
38 (corrugated on corrugated), etc.

The order of arrangement of the rigid and corrugated layers 27, 36, 37, 38 of this simple prism is separated from the thickness by one layer with regard to the order of arrangement of a contiguous prism. An example of such a contiguous prism is formed by the sequence of squares of the following folds, (FIG. 3E):

30 (corrugated on corrugated)
39 (rigid on rigid)
40 (corrugated on corrugated)
41 (rigid on rigid) etc.

Figure 9:
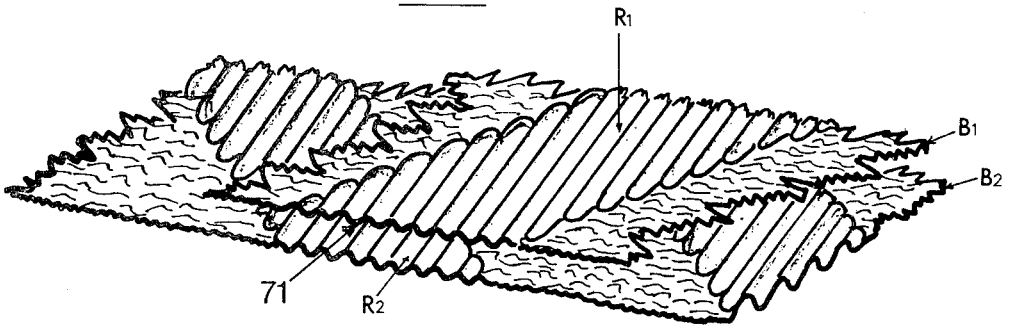
FIGS. 9–11 are partial perspective views of three kinds of textures, rigid on rigid, corrugated on corrugated, and rigid on corrugated in the defined spacings of the intersecting bands of contiguous ribbons.
Figure 10:
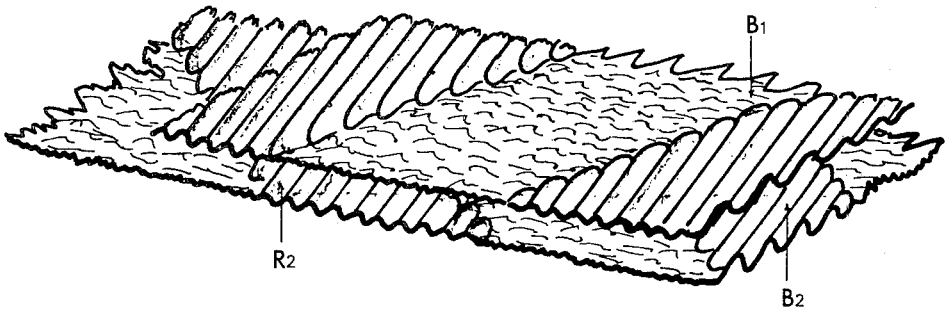
Figure 11:
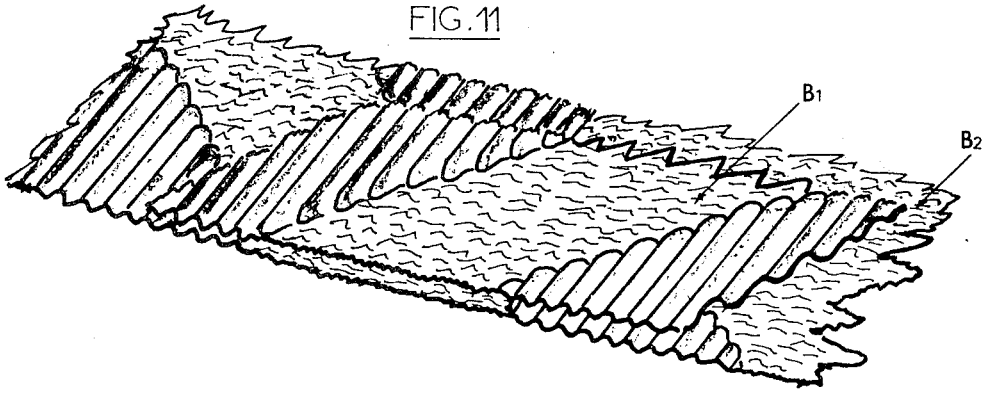

The rigid bands intersecting in contiguous ribbons B1-B2 (FIG. 9) are assembled in a network. This network is equally visible, FIG. 3F, by the intersection of bands 28 (ribbon B1) and 29 (ribbon B2), 45 (ribbon B4) and 46 (ribbon B5), 47 (ribbon B4) and 46 (ribbon B5), 46 (ribbon B5) and 48 (ribbon B6) etc. This network forms the skeleton of the filter structure principally because of the presence of the intersection in squares, veritable compact hubs in which the canals of one band are partially overlapped with the canals of the other band. This overlapping visible at 71, FIG. 9, links between them the spaces intersected in squares, thus reinforcing the skeleton of the filter structure. This hub N (FIGS. 3E, 3F) linkage of ribbons 4 and 5, 8 and 9, 12 and 13, FIG. 13) are alternated with cells defined by layers of two corrugated ribbons little compacted "C" (FIGS. 3E, 3F, linkage ribbon 2 and 3, 6 and 7, 10 and 11, FIG. 13, etc.).

The shaping into a cylindrical casing is done according to the teaching of French Patent No. 1,536,323 of June 30, 1967.

The assembled ribbons are curved which permits the stratified structure to be placed unchanged in the filter casing, from the structure before shaping. The sliding of ribbons one on the other are negligible in comparison with the transversal dimensions of the ribbons.

OPERATION OF THE INVENTION

In the filter structure embodiment hereinbefore described, the principal flow path of the smoke, which is oriented parallel to the axes of the filter, operates along a sinuous and baffled flow path which depends on the nature of the absorbent textures formed by the assembly of rigidified and longitudinally channeled material elements, and transversally corrugated material elements. This assembly is provided by squares of folds of two contiguous ribbon bands.

The three types of absorbent textures formed by the three combinations of the two assembled materials, (rigid on corrugated, corrugated on corrugated, rigid on rigid) oppose the smoke in a network of obstacles dispersed in the three dimensions forcing it to constantly modify its travel direction when passing from one type of texture to another kind.

In the mixed textures 72 and 73 (FIG. 3C) (assembly of a rigidified element and a corrugated element), the smoke progresses longitudinally in the canals formed by the short canaled sections by the wafered material defined by transverse folds of the corrugated material.

Leaving the mixed texture, the smoke penetrates the texture formed by the assembly of two corrugated elements. In this type of texture, taking into account the transverse disposition of the folds of the corrugated elements, the path of the smoke alters by 90°.

Figure 3C:
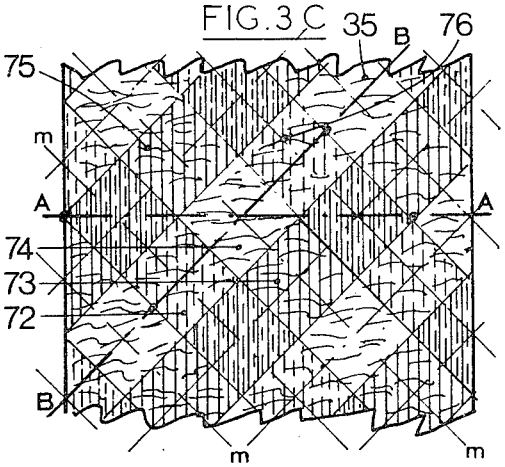
Figure 3D:
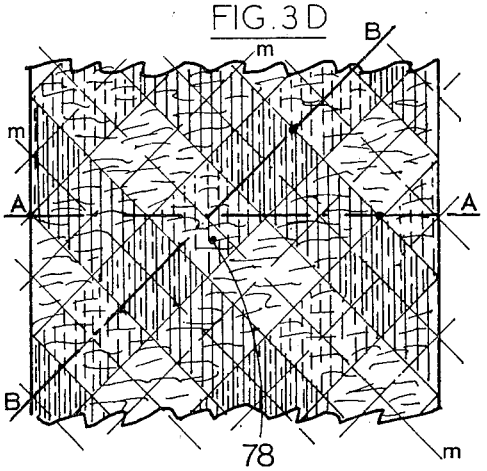
Figure 3E:
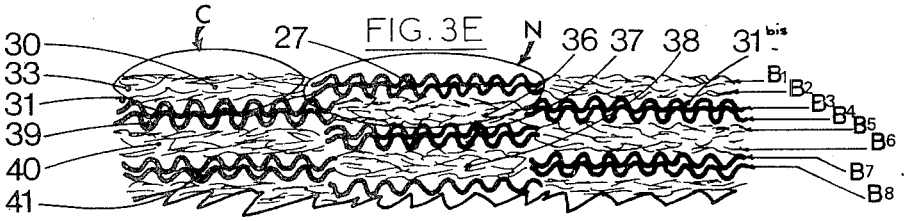
FIG. 3E shows a partial view of a transverse cut section of eight ribbons assembled along the line A—A of FIG. 3A.
Figure 3F:
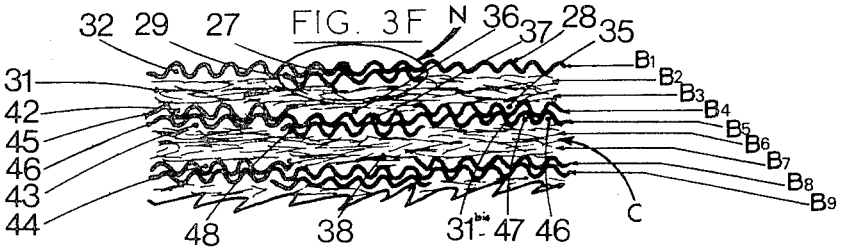
FIG. 3F is another partial view of an oblique cut section of the same ribbons assembled along the line B—B of FIG. 3A.

FIG. 3C shows that on leaving the mixed textures 72 and 73, the smoke penetrates in the texture 74 by the left and right simultaneously.

Since the assembly of these corrugated elements of these textures has little squeeze, the material is not a bit compacted. These textures constitute admirable absorbent cells for the smoke. At the same time these textures act as expansion chambers. Indeed, the joining of two opposing flows of smoke provoke a turbulence creating the phenomenon of the coalescence of particles of tar favoring their adhering to the fiber network of the absorbent partitions of the texture.

The smoke not detained follows its flow path in leaving the absorbent cells. A fraction exists into the mixed textures 75 and 76 situated downstream.

Another fraction tends to cross the partitions of the absorbent cells 74, permitting it to adhere to the adjacent mixed textures 77 (FIG. 3B), 78 (FIG. 3D), belonging to recovery levels situated in one part or another of cell 74. To the filtration mechanism of the tar by coalescence there is also added the mechanism of filtering by flowing across fiber networks of corrugated ribbons, assuring to the filter a retention efficiency superior to presently existing devices.

It is to be observed that the compact hubs of textures formed by the assembly of two rigidified elements which are longitudinally canaled are less absorbent than the two kinds of precipitated textures so that the increasing of the density of the material at the time of wafering nonetheless participates in the filtration of smoke which flows across the passages formed by the canals blocked between them. These passages are more or less strangled according to the degree of blocking of the channels.

The cycle hereinbefore described is repeated in the mass of the filter structure and the flowing of the smoke occurs more and more in the three planes: axial, lateral and radial.

The fact that the filter structure is obtained starting with a sheet of fiber material, geometrically shaped, and said sheet itself having the means necessary to produce a compact skeleton in the mass of the filter and, likewise the means necessary to obtain a network of paths for the smoke geometrically defined has numerous advantages. Indeed, the method according to the invention, while retaining the advantages inherent to the process of geometric formation in S-shape as described in French Patent No. 1,536,323, allows among other things the improvement in the characteristic of the filter as well as the rapid manufacture of the filter.

The improvement in the retention efficiency of the filter can be explained by the fact that the material employed is a wad of absorbent cellulose and that the perfect dispersion of the filter cells in the filter allows the smoke to flow along a sinuous and diverse path and using to the utmost the specific surface of the material.

The homogeneous nature of the filter structure resulting from stratification provides the filter with a good appearance which approximates a filter of cellulose acetate.

The possibility of varying the geometric types of the filter network makes it possible to obtain a larger fan of resistance to pulling and retentive efficiency regarding smoke tar and permits more suppleness in regulating the filter characteristics.

The fact that the material which constitutes the filter is unwound from one or two pay-off spools of greater length than the two spools of wad heretofore required results in reduction in the need to change spools so that the operator, until now, poorly served, is freed from a portion of his manual work which is required and allows him to pay more attention to the operation of his machine.

This reduction in the frequency of changing spools increases production. Indeed, the speed which was limited to about 200 m per minute due to the frequency of changing spools is now increased to speeds of 400 m per minute, the maximum speed of modern production.

It is to be further observed, therefore, that the present invention provides for a cigarette filter arrangement having improved smoke-tar filtering properties and which can be produced at the rate of the order of 400 m per minute. The filter arrangement is run off in sheets of transverse corrugated wad material and passed through a treating station where certain portions of the sheets are wafered forming rigid folds and other portions untouched. The wafering is done in longitudinal rows so as to form canals or channels. The sheets are then cut into ribbons and the ribbons are so superposed that the wafered rows on one sheet will be offset from the wafered rows on the other, the sheets then assembled one on the other so that the quadrilateral geometric designs are formed by rigid folds upon rigid folds, corrugation upon corrugation, and corrugation upon rigid fold. The sheet assembly is then rolled S-shape into a cylinder and the cylinder is then cut to make a cigarette filter tip.

I claim:

1. A method of forming a continuous cylindrical filter casing for cigarettes comprising:

a. continuously paying out an endless sheet of absorbant fibrous material with transverse corrugations;

b. rigidifying a series of first shaped portions of the sheet so as to define a predetermined geometric configuration which is repeated in the sheet longitudinal direction in accordance with a first repetition sequence and in the sheet transverse direction in accordance with a second repetition sequence, this rigidity being obtained by crushing corrugation ribs and forming on said first portions fine waffle-like longitudinal flutings, while leaving intact corrugated material of second portions of the sheet;

c. continuously cutting out lengths of ribbon in the longitudinal direction of the sheet of equal width, such that the segments of said first and second portions of each cut-out ribbon forms a motif repeated in the longitudinal direction of the ribbon in accordance with the longitudinal repetition sequence of the sheet;

d. continuously pivoting these ribbons by 90° over their central axis;

e. assembling these ribbons to form a ribbon pile so that the segments of each ribbon located in this pile between two perpendicular planes in the longitudinal direction of the ribbon and of a longitudinal dimension equal to the first repetition sequence of the motif is uniformly repeated in the longitudinal direction of the ribbon, the relationship between the width of the ribbons and said second repetition sequence being selected such that, for two continuous ribbons of the pile, the first portions of a first ribbon in certain locations contact the first portions of the second ribbons and in other locations contact the second portions of the second ribbon; and, f. continuously curving the pile of ribbons so as to have it conform to a cylindrical casing.

2. A method according to claim 1 wherein said first and second portions of the sheet are defined by first and second bands of equal width, bounded by alternate equidistant parallel bands of equal width, the dimension of the bands measured in the transverse direction of the sheet being an odd denomination of a fraction twice the width of the ribbons, the pivoting of the ribbons of even rows and those of odd rows being in the opposite direction.

3. A method according to claim 2 wherein the filter casing has at least 13 ribbons, the second stage of repition of the portions being equal to 1/7th of twice the width of a ribbon, the bands being inclined 45° in relationship to the longitudinal direction of the sheet.

4. A method according to claim 2 wherein the bands are turned 45° with relation to the longitudinal direction of the sheet.

5. A method according to claim 2 wherein there is produced a filter tip having at least 13 ribbons, the second repitition step of said portions corresponding to 1/7th of twice the width of one ribbon.

6. A method according to claim 1 wherein there is used for the endless sheet a cellulose absorbent wad with transversal corrugations, the formation of flutings causing a creasing of the corrugation nerves of the sheet causing a ridgidification of the sheet on the first several portions.

7. A method in accordance with claim 1 wherein the ribbons are piled so as to conform to a special S-shape to obtain a cylindrical filter tip.

8. A method according to claim 1 wherein there is produced a slight uncreasing of the material by loosening the pay-off means of the sheet by rubbing, the amount of this decreasage being controlled by varying the rate of speed between the pay-off means for the sheet and the means providing the formation of the channels.

* * * * *